United States Patent [19]

Krause et al.

[11] Patent Number: 4,511,063

[45] Date of Patent: Apr. 16, 1985

[54] SELF SUPPLYING HAWK

[75] Inventors: Glenn C. Krause, Humble, Tex.; Joseph Blounts, Las Vegas, Nev.

[73] Assignee: The Hoddie Corporation, Inc., Houston, Tex.

[21] Appl. No.: 501,109

[22] Filed: Jun. 6, 1983

[51] Int. Cl.[3] ..... B67D 5/12

[52] U.S. Cl. ..... 222/75; 222/529; 141/67; 294/3.5; 417/33; 417/900

[58] Field of Search ..... 222/75, 205, 511, 561, 222/626, 529; 401/188 R; 192/84 A, 84 C; 340/696, 825.72; 141/1-12, 37-70, 311 R, 369-382, 392, 98, 231, 325-327, 94, 95, 96; 294/3.5; 417/15, 33, 223, 900

[56] References Cited

U.S. PATENT DOCUMENTS

| | | | |
|---|---|---|---|
| 1,399,849 | 12/1921 | Chapin | 401/188 R |
| 2,535,726 | 12/1950 | Dalton | 222/205 |
| 3,315,263 | 4/1967 | Lefevre | 340/696 |
| 3,403,960 | 10/1968 | Ballard et al. | 401/188 |

FOREIGN PATENT DOCUMENTS

| | | | |
|---|---|---|---|
| 1449554 | of 1966 | France | 401/188 R |

*Primary Examiner*—Houston S. Bell, Jr.
*Attorney, Agent, or Firm*—James J. Smolen

[57] ABSTRACT

An apparatus for maintaining a continuous supply of cementitious material such as stucco or plaster on the hawk of a workman skilled in applying said materials to surfaces with a trowel. Cementitious material stored in bulk in a hopper remote from the workplace is pumped from said hopper through hose to the hawk of the skilled workman. The flowing lines are free of restrictions or valves and the flow is metered at its source by means of a radio transmitter controlled by the workman applying the cementitious material. Said radio transmissions activate the flow according to the needs of the workman.

2 Claims, 3 Drawing Figures

SELF SUPPLYING HAWK

BACKGROUND OF THE INVENTION (1) Field of The Invention

This invention pertains to an apparatus which transports cementitious material from a bulk supply of materials directly to a hawk whereon a supply of the material accumulates for application to a surface by a skilled workman with a trowel.

(2) Description of Prior Art

Cementitious materials, including but not limited to such materials as stucco and plaster, have traditionally been applied to both interior and exterior wall or ceiling surfaces with a trowel. The supply of cementitious material used by the said skilled workman is held on a hawk, which is comprised of a square plane metal surface below which and perpendicular thereto, a handle is mounted. The skilled workman typically holds the hawk in one hand and scoops cementitious material from the hawk with the trowel.

To replenish the material on the hawk, the skilled workman frequently supplies materials to the hawk from a nearby table on which cementitious material is stored. This storage table or mud board is typically replenished continually by other unskilled workers who move the cementitious materials from a mixer to said mud board by wheelbarrow, shovel, and the like. For work done above the first story, the cementitious material is transported to the elevated workplace by means of buckets, pulleys, and shovels.

The application of cementitious materials, as presently done and described above, entails the need for numerous unskilled workmen to supply the cementitious material to the workplace of the skilled workman. It furthermore requires that the skilled workman applying the material to the surface, who is skilled and trained in this trade, must frequently replenish his supply of cementitious material on his hawk by stopping what he is doing when he has used up the cementitious material on his hawk, walking to the material storage table or mud board where he places cementitous material on his hawk, and returning to his workplace to again apply this material to the surface with the trowel.

Delivery of plaster and similar materials directly to the hawk or to the trowel are known. However, all of these provide for a valve at or near the hawk or trowel, thereby causing pressure to build up in the flow line hose and hence cause surging or squirting of the cementitious material from the hawk or trowel surface. See U.S. Pat. No. 2,535,726 wherein a hawk is described which is equipped with a mechanical valve to control the flow of fluid plaster delivered thereto. See also U.S. Pat. No. 3,403,960 wherein a trowel is equipped with a mechanical valve at the trowel, and the apparatus therein described is designed to overcome surges in the flow. A further problem with such systems is that the cementitious material is caused to lose water at the valve, should it leak. This water loss causes the cementitious material to cake up and form a hard mass which restricts the continuing flow of cementitious material and, hence, causes the line to plug up or the valve to seize up. The occurrence of water loss and formation of cake buildup is also known to occur at points in the flowing line where the cross-section in said line is suddenly reduced. As a result of these shortcomings, none of these means of delivery directly to the hawk or trowel are in significant commercial use.

Unlike these previous embodiments, flow in this invention is unobstructed with flow lines of essentially constant cross-section and flow controlled at the pump directly by the skilled workman who is applying said cementitious material. Pressure in the flowing system is due primarily to hydrostatic head of the cementitious material, and hence, surging squirting and filter cake buildup are thereby eliminated.

SUMMARY OF THE INVENTION

The principal object of this invention is to improve the efficiency of skilled workmen in the application of cementitious material and to reduce the number of back-up unskilled workmen required to do a job.

The present invention provides a direct means of supplying the skilled workman's hawk from a bulk volume of cementitious material stored at or near the place where said cementitious materials are mixed. This invention further provides that the supply of cementitious material provided to the hawk is controlled by the skilled workman so that he may work at his optimum speed at all times. The highly paid skilled workman no longer must make frequent trips from the workplace to the mud board to replenish the supply of cementitious material on his hawk. As a further result, the number of unskilled workmen required at a site where cementitious material is being applied is reduced significantly, as are costs, without any impairment in the quality of the work done.

The self supplying hawk apparatus is comprised of a means to pump cementitious material from a bin containing said material in bulk, or where said cementitious material is mixed, through a hose to a hawk having a hollow handle connected to the said hose and through which the cementitious material flows to the hawk surface.

The pump is of a type which allows flow in only one direction and does not allow cementitious material to flow back. The most commonly used varieties of pumps include the progressive cavity and piston types. The flow line from the pump is comprised of a hose, miscellaneous connections, and a hawk with a flow through handle, to which the hose connects, and said elements in the flow system have essentially the same cross-section open to flow and free of valves, obstructions and the like. The pump is connected to a rotating power source by means of a clutch, whose engagement is controlled remotely by the skilled workman applying the cementitious material. Said control is achieved by a button and radio transmitter mounted on the hawk and controlled by the finger of the skilled workman. When pressed, said button causes a radio transmission which engages the clutch and causes cementitious material to flow to the hawk. The control button operates by means of a radio signal, acoustic signal, or hard wire connection to clutch actuating mechanism.

With this invention, the skilled workman applying cementitious material may scoop the material onto his trowel by a single motion wherein he slides the trowel on the hawk surface as is the traditional method of operation. While applying the material to the wall with the hand holding and working the trowel, the skilled workman may fill the hawk with the other in preparation for his next scoop therefrom, thereby eliminating the need to leave the immediate area of his workplace to fill the hawk repeatedly.

This invention further may be modified to incorporate multiple hawks, hoses, pumps, clutches, couplings, radio transmitters and receivers, and the like so that multiple skilled workmen, each with independent control of flow to their hawk may work using a single hopper of bulk cementitious material from which their needs are drawn.

Other features and characteristics of this invention will become apparent from the following description considered in connection with the accompanying figures.

DETAILED DESCRIPTION OF PREFERRED EMBODIMENT

For a better understanding of this invention, reference is now made to accompanying drawings in which all of the parts are numbered.

Figure 1:
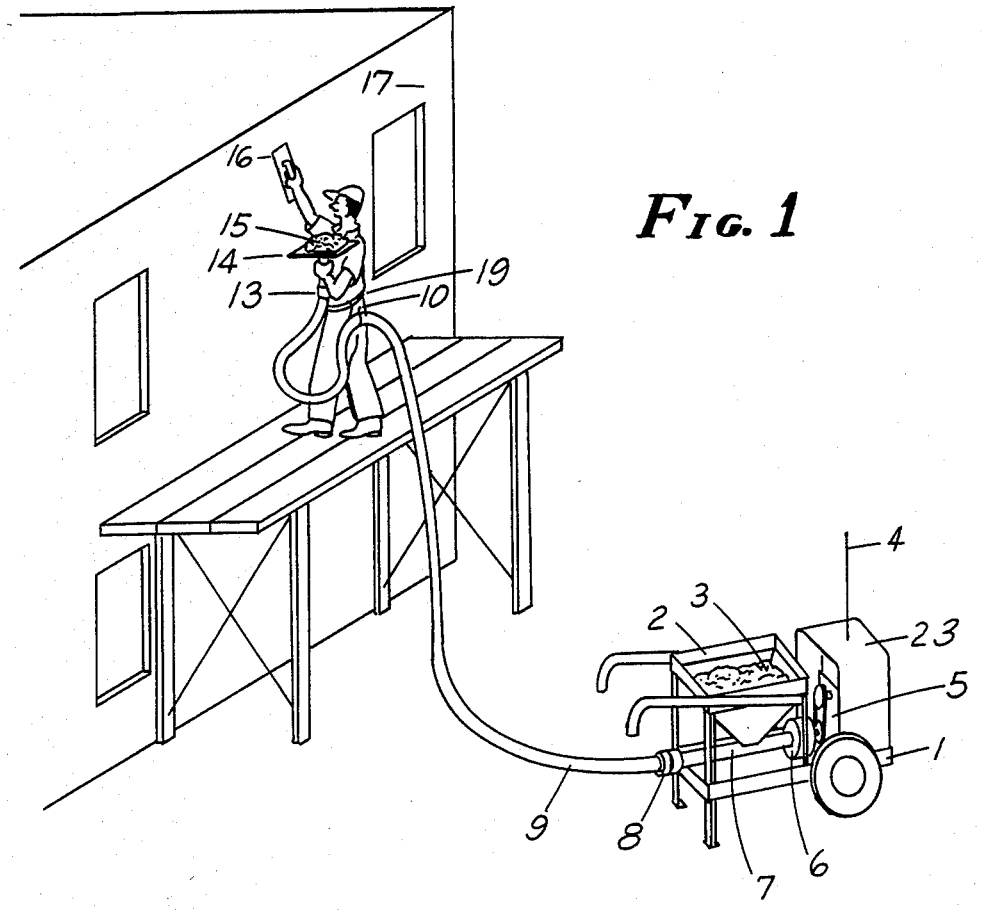
FIG. 1 is a view of a skilled workman holding a hawk and trowel in the traditional fashion as well as the means of delivery to the hawk of cementitious material.

In the embodiment shown in FIG. 1 the self supplying hawk is shown with the means of delivery of cementitious material thereto. It is comprised of a cart 1 on which is mounted a hopper 2 containing premixed cementitious material 3. A gasoline powered motor 5 is mounted on the cart 1 and drives a positive displacement progressive cavity pump 7 by engagement through the clutch 6. The clutch, 6, is an automotive air conditioner clutch. The pump 7 used in the preferred embodiment is a three stage progressive cavity pump rated to 330 p.s.i. manufactured by Spray Force, Inc. of Fresno, Calif., and driven by a twelve horsepower gasoline motor manufactured by the Kohler Company of Racine, Wis. Cementitious material 3, in viscous fluid form, is drawn from the hopper 2 by the pump 7 and caused to flow into the flow line hose 9 which is mounted to the pump 7 by means of connector 8. The flow line hose 9 is comprised of a heavy duty material capable of withstanding considerable traffic in the workplace and yet flexible for easy handling. Flow line hose 9 is attached to handle 22 of hawk 14 by means of a connector 13. A hook 10 may be attached and hung from the workman's belt 19 to support the hose full of cementitious material. All elements in the flow line, including the mounting connector 8, the flow line hose 9, the connector 13, and the hawk 14 have essentially the same flow area and do not restrict flow. The skilled workman scoops cementitious material 15 from the hawk 14 onto the trowel 16 for application to the wall 17. Radio transmitter 18 is enclosed in a housing 11 slidably mounted on hawk handle 22 and is activated by a button 20 on said housing 11. Receiver for said transmitted signal is mounted on cart 1 on the underside of the hood 23 and signal is detected by the aerial 4. The radio controlled transmitter and receiver components are essentially those used in automatic garage door openers and manufactured by the Pulsar Control Corporation of Hendersonville, Tenn. Activation of the button 20 controls flow to the hawk 14 by actuating or shutting off clutch 6.

Figure 2:
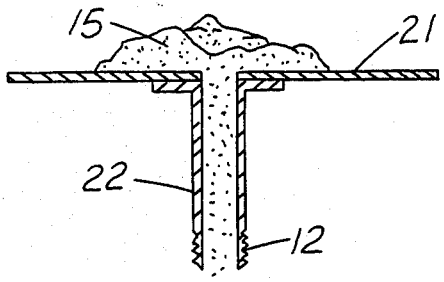
FIG. 2 is a section view through the hawk.

On FIG. 2 is shown section view of the hawk 14. It is comprised of a flat plate 21 of square shape having a hole therethrough at its center and a hollow handle 22 mounted to the plate 21 and perpendicular thereto. Onto said handle 22 and at the end opposite the plate 21 is a connecting means 12 for engagement with hose connector 13. Cementitious material 15 is free to pass through the hawk plate 21, the handle 22 and the connector 13.

Figure 3:
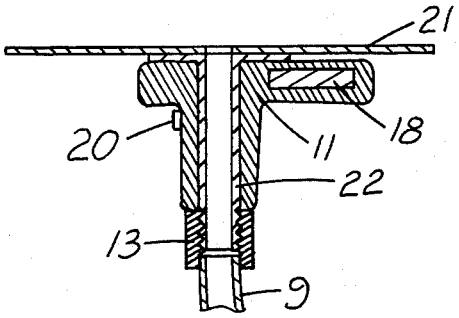
FIG. 3 is a view of the button and radio transmitter housing for controlling the clutch between the pump and the motor.

On FIG. 3 is shown the radio transmitter 18 mounted within the housing 11. Engagement of the button switch 20 activates the radio transmitter 18 which causes the clutch 6 to engage and hence pump cementitious material to said hawk 14. The housing 11 keeps dirt and foregin materials from damaging the transmitter 18. The housing 11 is mounted by sliding it over the hawk handle 22 and retaining it in position by the hose connector 13. Housing 11 is made of a plyable material which fits snugly over hawk handle 22 so as to not rotate relative hawk plate 21.

What is claimed is:

1. An apparatus for supplying cementatious material to a workman, which comprises:
   (a) a flat plate having a hole therethrough;
   (b) a handle having a bore therethrough rigidly affixed to said plate at one end, said bore being aligned with said hole in said plate;
   (c) a flexible hose having one end connected to the other end of said handle;
   (d) a hopper with a hole therethrough at its bottom;
   (e) a pump drawing cementitious material through said hole in said hopper and supplying said material to said hose;
   (f) a rotating power source;
   (g) a clutch releasably connecting said power source to said pump; and
   (h) a switch affixed to said handle controlling engagement of said clutch.

2. An apparatus for supplying cementitious material as recited in claim 1 wherein said switch affixed to said handle controlling engagement of said clutch comprises:
   (a) a means for activation of transmission of radio waves;
   (b) a means for receiving said radio transmissions; and
   (c) a means to engage said clutch upon receipt of said radio transmissions.

* * * * *